US005443398A

United States Patent [19]

Ortega

[11] Patent Number: 5,443,398

[45] Date of Patent: Aug. 22, 1995

[54] INVERSE BACKPLANE CONNECTOR SYSTEM

[75] Inventor: Jose L. Ortega, Louisville, Ky.

[73] Assignee: Robinson Nugent, Inc., New Albany, Ind.

[21] Appl. No.: 189,201

[22] Filed: Jan. 31, 1994

[51] Int. Cl.[6] ..... H01R 13/629

[52] U.S. Cl. ..... 439/378

[58] Field of Search ..... 439/378, 379, 680, 681, 439/79

[56] References Cited

U.S. PATENT DOCUMENTS

| | | | |
|---|---|---|---|
| 3,112,974 | 12/1963 | Curtis et al. | 439/680 |
| 4,304,457 | 12/1981 | Lissau . | |
| 4,420,215 | 12/1983 | Tengler . | |
| 4,449,767 | 5/1984 | Weidler | 439/681 |
| 4,466,684 | 8/1984 | Grant et al. . | |
| 4,607,907 | 8/1986 | Bogursky . | |
| 4,859,191 | 8/1989 | Tonooka et al. | 439/680 |
| 5,019,947 | 5/1991 | Pelzl | 439/681 |

FOREIGN PATENT DOCUMENTS

| | | | |
|---|---|---|---|
| 2743033 | 3/1979 | Germany | 439/681 |
| 3005364 | 8/1980 | Germany | 439/680 |

OTHER PUBLICATIONS

"High Density HDC Connectors", Robinson Nugent Brochure, four pages, 1991.

"2 Millimeter Two-Part Connectors for Use with Printed Boards and Backplanes", EIA/IS-64 specification, Electronics Industries Association, 30 pages, Mar. 1991.

"IEC 1076-4-001 Specification 48B.38.1", 64 pages, Nov. 1993.

"Millipacs 1 Female Signal Straight Solder Pins Connector—5 Rows", Souriau catalog, pp. 28 & 29, date unknown.

"Shrouded Headers—Right-Angle Solder-to-Board Signal Header", Berg Electronics Catalog, pp. 10-24 and 10-25, date unknown.

"Accessories—Guide Pin Kit", Berg Electronics Catalog, pp. 10-64 and 10-65, date unknown.

*Primary Examiner*—Gary F. Paumen

*Attorney, Agent, or Firm*—Barnes & Thornburg

[57] ABSTRACT

An electrical connector system is provided for coupling a fixed backplane to a removable daughtercard. The connector system includes a socket connector having a housing formed to include an array of pin-receiving windows therein, and a plurality of receptacle contacts located within the housing in alignment with the pin-receiving windows. The receptacle contacts include tail sections electrically coupled to the backplane. The socket connector also includes a plurality of cantilevered guide posts extending away from the housing. The connector system further includes a header connector having a housing and an array of contact pins secured in the housing for engaging the receptacle contacts of the socket connector. The contact pins include tail sections electrically coupled to the daughtercard. The housing of the header connector is formed to include a plurality of guide slots aligned axially with the cantilevered guide posts formed on the socket connector. The guide slots are configured so that the guide posts enter the guide slots as the socket connector and the header connector are mated to align the array of pin-receiving windows of the socket connector with the array of pins of the header connector.

32 Claims, 4 Drawing Sheets

INVERSE BACKPLANE CONNECTOR SYSTEM

BACKGROUND AND SUMMARY OF THE INVENTION

The present invention relates to a two part modular connector system for interconnecting a backplane printed circuit board to a daughtercard printed circuit board. More particularly, the present invention relates to an improved two part backplane connector system which provides a drop in replacement for a standard two part backplane connector system.

The current industry standard for a two part modular connector system for electrically coupling a backplane to a daughtercard is set in the United States by specification EIA/IS-64 from Electronic Industries Association. This specification sets out parameters for 2 mm, two-part connectors for use printed with circuit boards and backplanes. The international standard for such two-part connectors is set forth in IEC 1076-4-001 specification 48B.38.1. Both of these specifications define a daughtercard connector (free board connector) that includes female receptacle contacts and a backplane or motherboard connector (fixed board connector) that contains male pin contacts. A connector that contains female receptacle contacts is commonly referred to as a "socket" connector, and a connector that contains male pin contacts is commonly referred to as a "header" connector.

One of the most vulnerable aspects of a pin and receptacle contact system is that pin contacts may be permanently warped or bent out of alignment due to impacting an edge or other blunt surface of a plastic socket connector housing during mating of the socket connector with the header connector. Such damage to the pins of the header connector can occur when an attempt is made to mate two connector halves without achieving proper alignment between the socket connector and the header connector. Improper alignment between the header connector and the socket connector can be the result of many causes, such as using component parts that are out of the allowable design tolerance, printed circuit board bow or warpage, insufficient or excessive clearance in card slot guides, improper part orientation, or mishandling before attempting to mate the socket connector and the header connector. When improper mating occurs, repair of bent pins of the header connector often require shutting off power to, and then removal of, the printed circuit board containing the damaged components. If a header connector containing damaged male pins is on a backplane or fixed board connector, repair often requires complete system shutdown and dismantling which is time consuming and expensive. If the header connector is on a daughtercard or free board connector, however, as is the case in the present invention, repair of damaged pins is much simpler and inexpensive. Depending on the electrical design, such repair to a header connector on the removable daughtercard does not require a complete system power down. In addition, if the pin damage to the header connector is unserviceable and requires a complete board replacement, it is usually more expensive to replace a thicker, multi-layer backplane printed circuit board than it is to replace a daughtercard.

As discussed above, the standard specification for two-part connectors for use with printed circuit boards and backplanes specifies that a header connector is coupled to the backplane and a socket connector is coupled to the daughtercard. Therefore, if pins of the header connector are damaged, the standard specification for such two-part connectors often requires more expensive servicing than would be the case if the header connector was mounted on a daughtercard.

Therefore, one object of the present invention is to provide a two-part modular connector system fully compatible with the EIA and IEC specifications and which has the header connector mounted on the daughtercard instead of the backplane to facilitate servicing if repair to the header connector pins is required.

Another advantage of having a socket connectors on the backplane printed circuit board is to obtain an Underwriters Laboratories (UL) user accessible electronic equipment classification. There is a UL requirement that electrical contacts reaching certain voltage or current levels not be "exposed" on systems that can be upgraded or accessed internally by users. Since female receptacle contacts are individually isolated and covered by a thermoplastic socket housing, the receptacle socket contacts are shielded from access by a user, thereby facilitating compliance with UL requirements.

The present invention provides a two part, modular connector system having a basic grid spacing between contact tails of 2 mm. The connector coupled to the backplane PCB is a straight socket connector containing female receptacle contacts. The connector coupled to the daughtercard PCB is a right angle header connector containing male pin contacts. The contact tails on both the header connector and socket connector can be designed to accommodate either solder attachment or solderless compliant pin terminations to plated through holes of a printed circuit board. The connector system of the present invention is 100% footprint and card-cage layout compatible with existing EIA/IS-64 and IEC 48B.38.1 standards. The relationship between the corresponding printed circuit board locations is exactly the same as the standard specifications. The term "stub length" refers to the distance from the backplane PCB surface to the first row of plated through holes on the daughtercard. The stub length provided by the connector system of the present invention is identical to the EIA and IEC standard connector stub length. This stub length is an important electrical parameter because it affects the overall electrical signal travel distance on the system bus and influences other electrical characteristics such as electrical path resistance, propagation delay, skew, impedance, etc.

Another important design requirement of two part connector systems is that of adequate plastic engagement or alignment before the electric contacts begin to mate. This is required in order to minimize potential bent pin problems as discussed above. In the standard EIA/IEC connector design, this engagement is accomplished by providing relatively high header walls that extend substantially above the pin contacts contained within these walls. (See FIG. 5 below.) This assures that the header connector and socket connector bodies will align themselves before contact engagement occurs.

An inverse connector configuration of the present invention which is also required to be compatible with this EIA and IEC layout standard, is significantly limited in the plastic-to-plastic engagement that can be achieved by using header walls to align the socket body before the electrical contacts interact. This difficulty arises because in the standard EIA and IEC design, a portion of the daughtercard actually becomes contained within an interior region between the header walls along the socket connector. With an inverse connector configuration of the present invention, this partial printed circuit board containment within the header connector is lost. In essence, layout compatibility forces the height of the inverse header connector walls and the overall height of the inverse socket connector to be significantly reduced.

The present invention provides an alternative method for generating plastic-to-plastic engagement without compromising compatibility with the modularity, layout geometry, and end-to-end stackability of the EIA/IEC design specification. A guide post feature was designed into the inverse two-part connector system of the present invention. The guide posts project in a cantilevered fashion from one side wall of the socket connector and are designed to fit within slot openings formed in a mating wall of the header connector. The guide posts accomplish the plastic-to-plastic engagement and alignment of the header connector with the socket connector before there is any electrical interaction between the pins of the header connector and the receptacle contacts of the socket connector. Therefore, plastic-to-plastic engagement is provided without compromising layout compatibility, end-to-end stackability, or modularity. The guide posts of the present invention advantageously provide alignment between the header connector and the socket connector without the loss of contact position and without requiring the use of additional printed circuit board real estate.

Another object of the present invention is to provide an inverse two-part modular connector system for coupling a daughtercard to a backplane which is 100% layout compatible with specifications EIA/IS-64 and IEC 1076-4-001 48B.38.1.

Other inverse 2 mm grid, two-part connector components are known. However, these components are not 100% EIA/IEC layout compatible. These known connectors do not retain the stub length dimension set forth in the EIA/IEC specifications. Particularly, the standard stub length dimension of 17.0 mm is determined by adding the "M" dimension as described in pages 14 and 15 (M=13.0 mm) of the IEC document, to the 4.0 mm distance from a mounting peg hole in the daughtercard to the first row of plated through holes in the daughtercard as described on pages 42–44 and FIGS. 32–36 of the IEC specification. Other inverse connector designs require that the daughtercard be located at least an additional 3.0 mm above the backplane surface. See for example, the Souriau Millipacs 1 and Berg METRAL connectors. This stub length differential prevents these designs from being a "drop in" replacement to backplane and daughtercard cage layouts which use the standard EIA or IEC two-part connector specification. These known components are intended for parallel stacking (Souriau Millipacs 1) or for cable-to-board (METRAL) applications, and are not designed to be drop in replacements for standard EIA/IEC specified backplane designs.

According to one aspect of the present invention, an electrical connector system is provided for coupling a first printed circuit board to a second printed circuit board. The connector system includes a socket connector having a housing formed to include an array of pin-receiving windows therein, and a plurality of receptacle contacts located within the housing in alignment with the pin-receiving windows. The receptacle contacts include tail sections electrically coupled to the first printed circuit board. The socket connector also includes a plurality of cantilevered guide posts extending away from the housing. The connector system further includes a header connector having a housing and an array of contact pins secured in the housing for engaging the receptacle contacts of the socket connector. The contact pins include tail sections electrically coupled to the second printed circuit board. The housing of the header connector is formed to include a plurality of guide slots aligned axially with the cantilevered guide posts formed on the socket connector. The guide slots are configured so that the guide posts enter the guide slots as the socket connector and the header connector are mated to align the array of pin-receiving windows of the socket connector with the array of pins of the header connector.

In the illustrated embodiment, the cantilevered guide posts formed on the socket connector include a generally rectangular body portion and a head portion having a pair of opposed ramp surfaces. The opposed ramp surfaces facilitate insertion of the guide posts into the guide slots of the header connector.

According to another aspect of the present invention, a modular connector system is provided for electrically coupling a fixed backplane printed circuit board to a removable daughtercard printed circuit board. The connector system includes a socket connector having a housing formed to include an array of pin-receiving windows therein, and a plurality of receptacle contacts located within the housing in alignment with the pin-receiving windows. The receptacle contacts include tail sections electrically coupled to the backplane. The connector system also includes a header connector having a housing and an array of contact pins secured in the housing for engaging the receptacle contacts of the socket connector. The contact pins include tail sections electrically coupled to the daughtercard. The socket connector and header connector are configured to provide a stub length of 17.0 mm between the backplane and the daughtercard upon insertion of the header connector into the socket connector.

In the illustrated embodiment, the header connector includes a peg for engaging an alignment hole formed in the daughtercard to position the alignment hole of the daughtercard 14.0 mm away from a top surface of the backplane upon insertion of the header connector into the socket connector. A top surface of the daughtercard is spaced apart from a first row of the array of contact pins of the header connector by 1.5 mm.

According to yet another aspect of the present invention, a modular connector system is provided for coupling a fixed backplane printed circuit board to a removable daughtercard printed circuit board. The connector system includes a socket connector having a housing including a top surface formed to include an array of pin-receiving windows therein and a side wall generally perpendicular to the top surface. The socket connector also includes a plurality of receptacle contacts located within the housing in alignment with the pin-receiving windows. The receptacle contacts including tail sections electrically coupled to the daughtercard. The socket connector further includes a cantilevered guide post having a proximal end formed integrally with the side wall of the housing and a distal end extending upwardly away from the side wall of the housing. The connector system further includes a header connector including a housing having first and second spaced apart side walls defining an interior region therebetween. The header connector also includes an array of contact pins secured in the housing and located within the interior region for engaging the receptacle contacts of the socket connector. The contact pins include tail sections electrically coupled to the second printed circuit board. The first side wall of the housing of the header connector is formed to include a guide slot having a first slot portion formed in the interior region and a slot opening extending through the first side wall. The guide slot is aligned axially with the cantilevered guide post formed on the socket connector. The guide slot is configured so that the guide post engages the first portion of the guide slot in the interior region as the socket connector and the header connector are mated to align the array of pin-receiving windows of the socket connector with the array of pins of the header connector. The distal end of the guide post extends through the slot opening in the first side wall of the header connector to lie outside the interior region of the header connector upon insertion of the header connector onto the socket connector.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2:
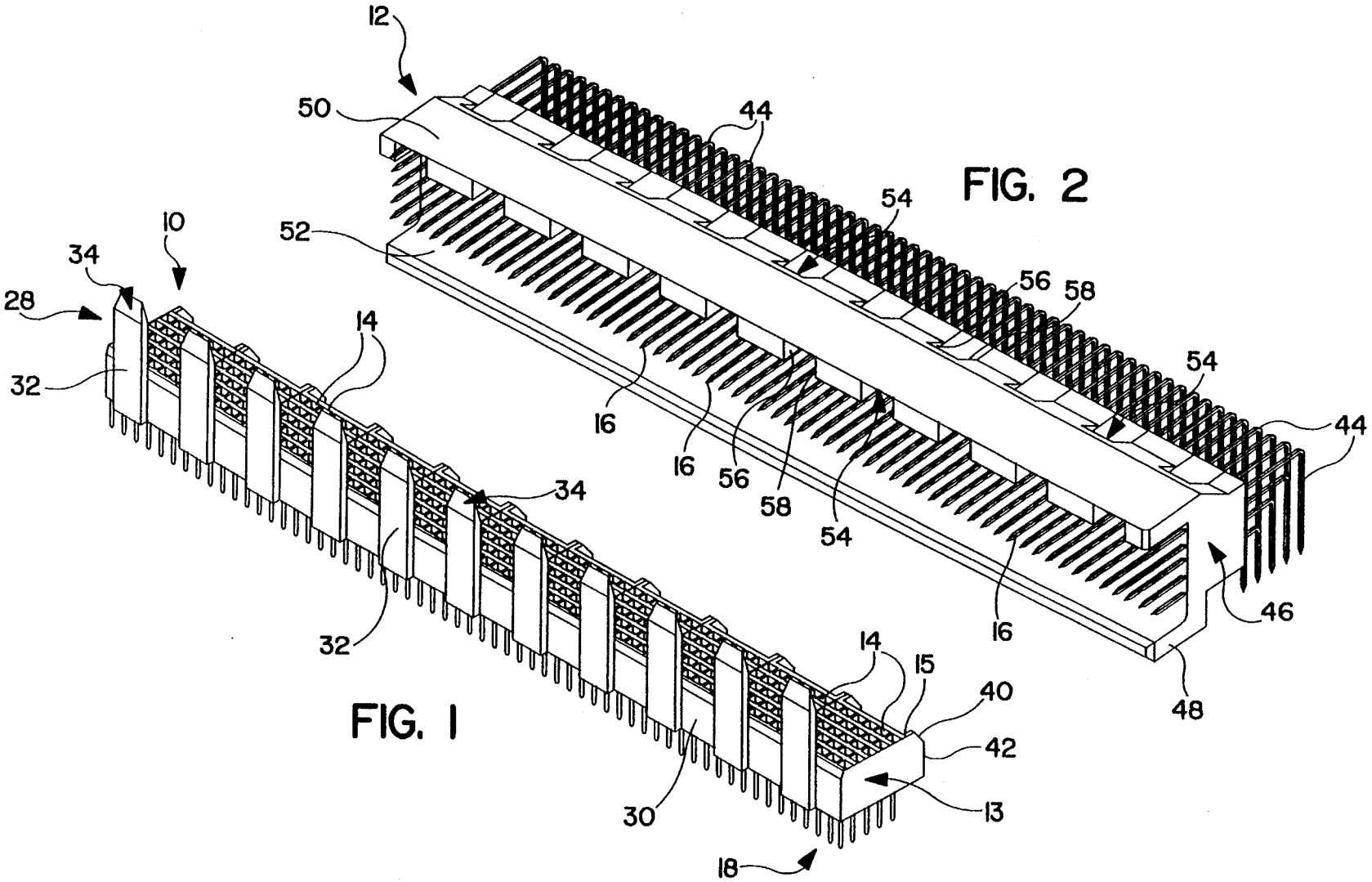
FIG. 1 is a perspective view of a socket connector configured to be coupled to a backplane printed circuit board and including a plurality of guide posts projecting away from the socket connector for aligning the socket connector relative to a header connector.
FIG. 2 is a perspective view illustrating a header connector of the present invention configured to be coupled to a daughtercard printed circuit board and formed to include a plurality of guide slots for receiving the guide posts of the socket connector therein.

Referring now to the drawings, FIGS. 1 and 2 illustrate the two-part modular connector system for electrical coupling a backplane printed circuit board 26 to a daughtercard printed circuit board 45. FIG. 1 illustrates a female socket connector 10 of the present invention. Socket connector 10 is configured to be mounted on a backplane printed circuit board 26 which is typically fixed within an electronic component. FIG. 2 illustrates a right angle male header connector 12 which is configured to be electrically coupled to a removable daughtercard printed circuit board 45.

Figure 4:
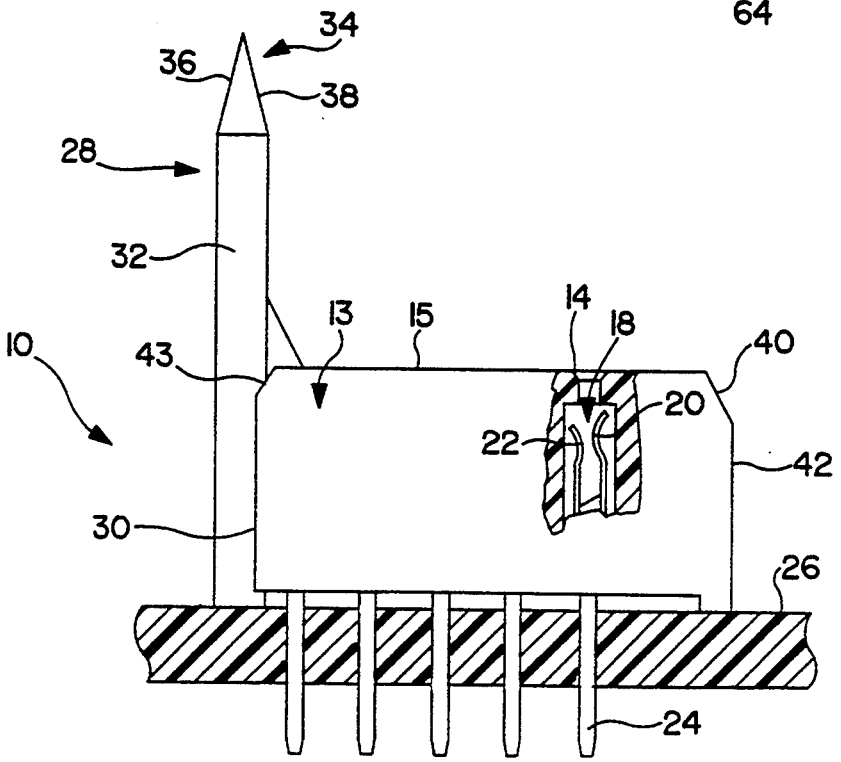
FIG. 4 is an end elevational view of the socket connector of FIG. 1 mounted on a backplane with portions broken away to illustrate details of the female receptacle contacts.

Socket connector 10 includes a thermoplastic insulated housing 13 formed to include a plurality of pin insertion windows 14 formed in top surface 15 for receiving pins 16 of header connector 12 therein. Female socket receptacle contacts 18 located within housing 13 aligned with each of the pin insertion windows 14. As illustrated in FIG. 4, female contacts 18 include dual beam receptacle contacts 20 and 22 and a tail 24 for coupling contacts 18 to a backplane printed circuit board 26. Illustratively, the spacing between tails 24 is 2.0 mm. A plurality of guide posts 28 are formed integrally with housing body 12, extending upwardly from side wall 30 in a cantilevered fashion. Guide posts 28 include a generally rectangular body portion 32 and a head portion 34 having opposite ramp surfaces 36 and 38. A ramp surface 40 is formed between top surface 15 and side wall 42 of housing 13 A ramp surface 43 is also formed between top surface 15 and side wall 30. Proximal ends of guide posts 28 are formed integrally with side wall 30. Distal ends of guide posts 28 extend upwardly away from side wall 30.

Contact pins 16 of header connector 12 include tail portions 44 for coupling contact pins 16 to a daughtercard printed circuit board in a conventional manner. Illustratively, the spacing between tails 44 is 2.0 mm. Contact pins 16 extend through an insulated thermoplastic housing 46 having a first side wall 48 and a spaced-apart second side wall 50 defining an interior region 52 therebetween for housing pins 16 of header connector 12. Side wall 50 of housing 46 is formed to include a plurality of post-receiving guide slots 54 therein. Slots 54 are defined by opposite side walls 56 and 58. Guide slots 54 include a first slot portion located in interior region 52 and a slot opening extending through side wall 50. Slots 54 are aligned at the same longitudinal positions as guide posts 28. Slots 54 are sized to receive guide posts 28 therein during insertion of header connector 12 onto socket connector 10 to insure alignment between pins 16 of header connector 12 and pin-receiving windows 14 of socket connector 10.

Figure 3:
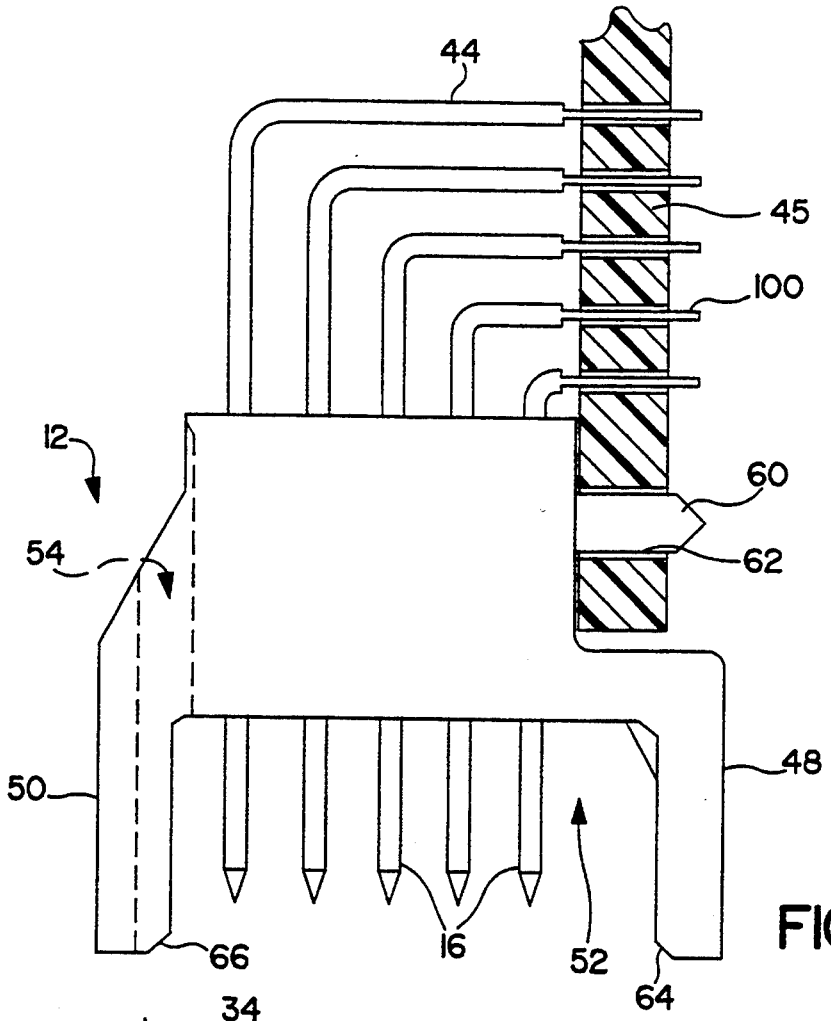
FIG. 3 is an end elevational view of the header connector of FIG. 2 mounted on a daughtercard.

As illustrated in FIG. 3, header connector 12 is formed to include an alignment peg 60 for engaging an alignment aperture 62 formed in daughtercard 45 to align daughtercard 45 relative to header connector 12. Header connector 12 includes a ramp surface 64 in side wall 48 and a ramp surface 66 in side wall 50. Ramp surfaces 40 and 43 on socket connector 10 cooperate with ramp surfaces 64 and 66 on header connector 12 to facilitate insertion of header connector 12 onto socket connector 10. Ramp surfaces 36 and 38 on head 34 of guideposts 28 also facilitate insertion of guideposts 28 into slots 54 of header connector 12.

Figure 5:
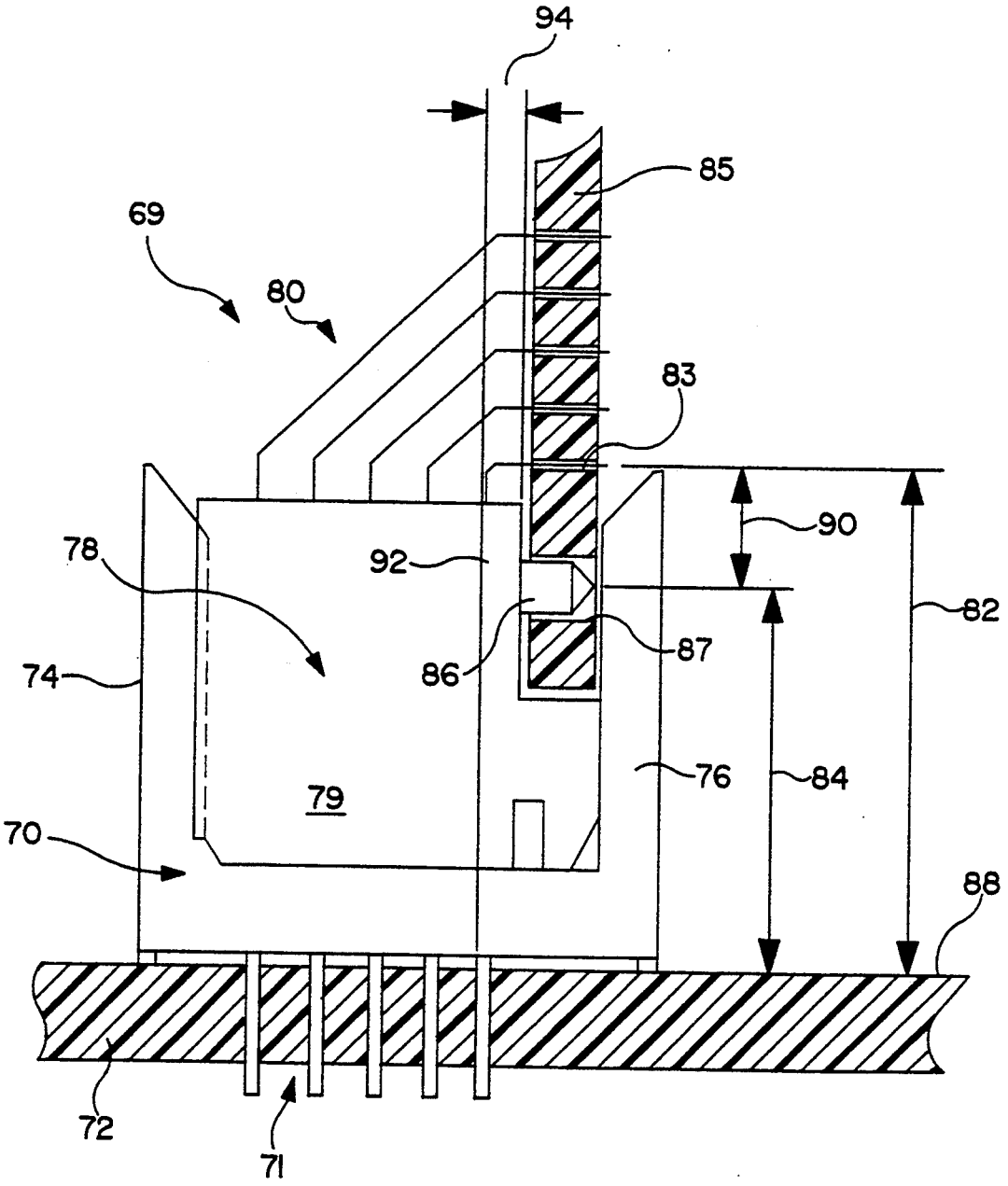
FIG. 5 PRIOR ART
FIG. 5 is an end view of a prior art two-part connector system for coupling a daughtercard to a backplane made in accordance with EIA and IEC specifications and including a male header connector coupled to the backplane and a female socket connector coupled to the daughtercard.

The connector system of the present invention is designed to be a drop in replacement for a conventional 2 mm, two-part connector system for use with printed circuit boards and backplanes. The standard connector system 69 set forth in specifications IEC 1076-4-001 48B.38.1 and EIA/IS-64 is illustrated in FIG. 5. In the standard specified design, a straight header connector 70 is mounted on backplane printed circuit board 72. Header connector 70 includes first and second side walls 74 and 76 defining an interior region 78 therebetween for receiving right angle socket connector 79. Socket connector 79 includes female contacts 80 for engaging male pin contacts 71 of header connector 70. The conventional modular connector system has a stub length illustrated by dimension 84 in FIG. 5 of 17.0 mm. The "M" dimension 84 from the mounting peg 86 and alignment hole 87 to the top surface 88 of backplane printed circuit board 72 specified is 13.0 mm. The "M" dimension 84 is added to the distance from mounting peg 86 and alignment hole 87 to the first row of plated through holes 83 of daughtercard 85 as illustrated by dimension 90 to obtain the stub length 82. Dimension 90 is 4.0 mm. The specified distance from a top surface of daughtercard 85 to a center line of a row A contact illustrated by line 92 is illustrated by dimension 94. Illustratively, dimension 94 is specified as 1.50 mm. As discussed above, the spacing between adjacent contact tails of male pins 71 and female contacts 80 is 2.0 mm.

The connector system 69 specified in the EIA/IEC specifications provides side walls 74 and 76 on header connector 70 which extend a substantial distance upwardly away from top surface 88 of backplane 72. This is required to ensure adequate plastic engagement for alignment before electrical contacts 71 and 80 begin to mate. As illustrated in FIG. 5, an end portion of daughtercard 85 also moves into interior region 78 defined between side wall 74 and 76 of header connector 70. This makes it difficult to design an inverse connector system which provides adequate plastic-to-plastic contact while maintaining the specified stub length 82.

Figure 6:
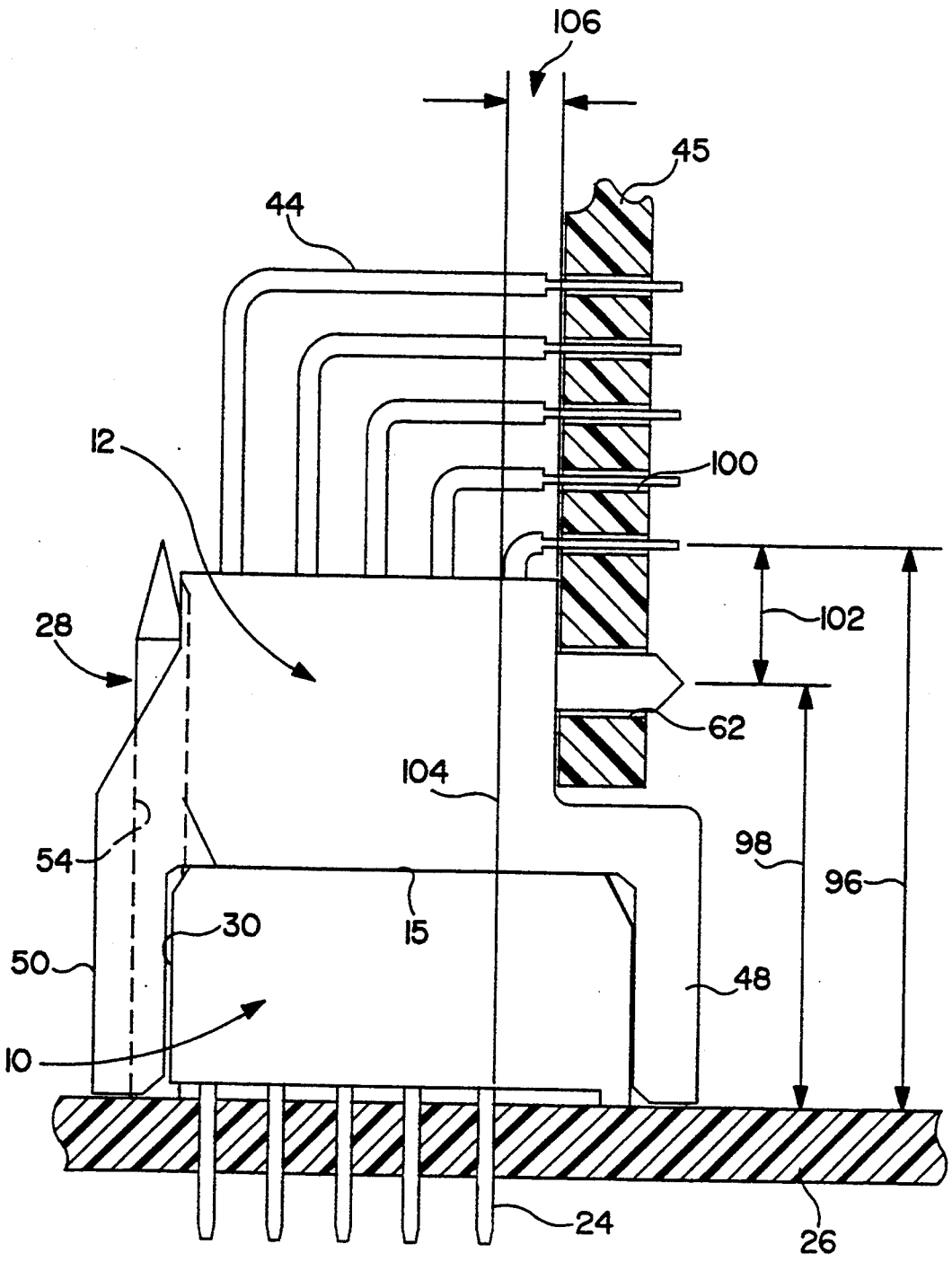
FIG. 6 is an end elevational view of the inverse connector system of the present invention with the male header connector coupled to the female socket connector.

FIG. 6 illustrates the two-part modular connector system of the present invention installed onto a backplane printed circuit board 26 for electrically coupling daughtercard 45 to backplane 26. As illustrated in FIG. 6, the connector assembly of the present invention has a stub length illustrated by dimension 96, a "M" dimension illustrated by dimension 98, and a distance from the center of alignment hole 62 of daughtercard 45 to the first plated through hole 100 of daughtercard 45 illustrated by dimension 102. The novel configuration of the connector system of the present invention advantageously provides a stub length 96 of 17.0 mm, the same as for the standard specified connector system of FIG. 5. In addition, the "M" dimension 98 is 13.0 mm, and dimension 102 is 4.0 mm. Therefore, these dimensions are also identical to the standard specified dimensions illustrated in FIG. 5. Finally, the distance from a top surface of daughtercard 45 to a center line of contact row A illustrated at location 104 is illustrated by dimension 106. Dimension 106 is 1.5 mm which is identical to dimension 94 in FIG. 5. Therefore, the inverse connector system of the present invention is advantageously 100% PCB footprint and backplane compatible with the industry standard 2 mm IEC 48B.38.1 or EIA IS-64 specifications.

The connector system of the present invention is advantageously able to maintain the specified two-part connector system dimensions while maintaining adequate plastic-to-plastic contact between socket connector 10 and header connector 20 to ensure proper engagement between pins 16 and receptacle contacts 18. This plastic-to-plastic contact is provided by guide posts 28 which extend from socket connector 10 in a cantilevered fashion and engage slots 54 formed in header connector 12. As illustrated in FIG. 6, the distal end of guide post 28 extends outwardly through the slot opening 54 formed in side wall 50 to lie outside of interior region 52 and permit header connector 12 to move closer to backplane 26 while maintaining the required plastic-to-plastic contact between header connector 12 and socket connector 10 necessary to ensure alignment between contact pins 16 and receptacle contacts 18 upon insertion of header connector 12 onto socket connector 10.

Although the invention has been described in detail with reference to a certain preferred embodiment, variations and modifications exist within the scope and spirit of the invention as described and defined in the following claims.

What is claimed is:

1. An electrical connector system for coupling a first printed circuit board to a second printed circuit board, the connector system comprising:

a socket connector including a socket housing having a top surface formed to include an array of pin-receiving windows therein, a plurality of receptacle contacts located within the socket housing in alignment with the pin-receiving windows, the receptacle contacts including tail sections configured to be electrically coupled to the first printed circuit board, and a plurality of cantilevered guide posts one-piece with and extending away from the socket housing above the top surface of the socket housing; and a header connector including a header housing and an array of contact pins secured in the header housing for engaging the receptacle contacts of the socket connector, the contact pins including tail sections configured to be electrically coupled to the second printed circuit board, the header housing being formed to include a plurality of guide slots aligned axially with the plurality of cantilevered guide posts formed on the socket connector, the guide slots being configured to surround a distal end of the guide posts as the socket connector and the header connector are mated to align the array of pin-receiving windows of the socket connector with the array of pins of the header connector prior to engagement of the array of contact pins with the plurality of receptacle contacts.

2. The connector system of claim 1, wherein the cantilevered guide posts formed on the socket connector include a body portion and a head portion having a ramp surface to facilitate insertion of the guide posts into the guide slots of the header connector.

3. The connector system of claim 2, wherein the body portion has a generally rectangular shape.

4. The connector system of claim 2, wherein the head portion includes a pair of opposed ramp surfaces to facilitate insertion of the guide posts into the guide slots of the header connector.

5. The connector system of claim 1, wherein the socket connector and header connector are configured to provide a stub length of 17.0 mm between the first and second printed circuit boards upon insertion of the header connector into the socket connector.

6. The connector system of claim 1, wherein the first printed circuit board is a fixed backplane and the second printed circuit board is a removable daughtercard.

7. The connector system of claim 1, wherein the header connector includes a peg for engaging an alignment hole formed in the second printed circuit board to position the alignment hole of the second printed circuit board 14.0 mm away from a top surface of the first printed circuit board upon insertion of the header connector into the socket connector.

8. The connector system of claim 1, wherein a top surface of the second printed circuit board is spaced apart from a first row of the array of contact pins of the header connector by 1.5 mm.

9. A modular connector system for electrically coupling a fixed backplane printed circuit board to a removable daughtercard printed circuit board, the connector system comprising:

a socket connector including a socket housing formed to include an array of pin-receiving windows therein, a plurality of receptacle contacts located within the socket housing in alignment with the pin-receiving windows, the receptacle contacts including tail sections configured to be electrically coupled to the backplane, the socket connector including a cantilevered guide post one-piece with and extending away from a side wall of the socket housing; and a header connector including a header housing and an array of contact pins secured in the header housing for engaging the receptacle contacts of the socket connector, the contact pins including tail sections configured to be electrically coupled to the daughtercard, the header connector including a guide slot aligned with the guide post, the guide slot being configured to surround a distal end of the guide post as the socket connector and header connector are mated to align the array of pin-receiving windows of the socket connector with the array of pins of the header connector prior to engagement of the array of contact pins with the plurality of receptacle contacts.

10. The connector system of claim 9, wherein the cantilevered guide post formed on the socket connector includes a body portion and a head portion having a ramp surface to facilitate insertion of the guide post into the guide slot of the header connector.

11. The connector system of claim 10, wherein the head portion includes a pair of opposed ramp surfaces to facilitate insertion of the guide post into the guide slots of the header connector.

12. The connector system of claim 9, wherein the header connector includes a peg for engaging an alignment hole formed in the daughtercard to position the alignment hole of the daughtercard 14.0 mm away from a top surface of the backplane upon insertion of the header connector into the socket connector.

13. The connector system of claim 9, wherein a top surface of the daughtercard is spaced apart from a first row of the array of contact pins of the header connector by 1.5 mm.

14. A modular connector system for coupling a first printed circuit board to a second printed circuit board, the connector system comprising:

a socket connector including a socket housing having a top surface formed to include an array of pin-receiving windows therein and a side wall generally perpendicular to the top surface, a plurality of receptacle contacts located within the socket housing in alignment with the pin-receiving windows, the receptacle contacts including tail sections configured to be electrically coupled to the first printed circuit board, and a cantilevered guide post including a proximal end formed integrally with the side wall of the housing and a distal end extending upwardly away from the side wall of the socket housing; and a header connector including a header housing having first and second spaced apart side walls defining an interior region therebetween, an array of contact pins secured in the header housing and located within the interior region for engaging the receptacle contacts of the socket connector, the contact pins including tail sections configured to be electrically coupled to the second printed circuit board, the first side wall of the header housing being formed to include a guide slot including a first slot portion formed in the interior region and a slot opening extending through the first side wall, the guide slot being aligned axially with the cantilevered guide post formed on the socket connector, the guide slot being configured so that the guide post engages the first portion of the guide slot in the interior region as the socket connector and the header connector are mated to align the array of pin-receiving windows of the socket connector with the array of pins of the header connector, the distal end of the guide post extending through the slot opening in the first side wall of the header connector to lie outside the interior region of the header connector upon insertion of the header connector into the socket connector.

15. The connector system of claim 14, wherein the socket connector includes a plurality of axially spaced cantilevered guide posts, and the header connector includes a plurality of guide slots aligned axially with the plurality of cantilevered guide posts.

16. The connector system of claim 14, wherein the cantilevered guide post formed on the socket connector includes a body portion and a head portion including a pair of opposed ramp surfaces to facilitate insertion of the guide post into the guide slots of the header connector.

17. The connector system of claim 14, wherein the header connector includes a peg for engaging an alignment hole formed in the daughtercard to position the alignment hole of the daughtercard 14.0 mm away from a top surface of the backplane upon insertion of the header connector into the socket connector.

18. The connector system of claim 14, wherein a top surface of the daughtercard is spaced apart from a first row of the array of contact pins of the header connector by 1.5 mm.

19. An electrical connector system for coupling a first printed circuit board to a second printed circuit board, the connector system comprising:

a socket connector including a socket housing having a top surface formed to include an array of pin-receiving windows therein, a plurality of receptacle contacts located within the socket housing in alignment with the pin-receiving windows, the receptacle contacts including tail sections configured to be electrically coupled to the first printed circuit board, and a plurality of cantilevered guide posts extending away a first side of the socket housing above the top surface of the socket housing; and a header connector including a header housing having a first side wall and a second side wall spaced apart from the first side wall, the header housing having first and second open ends to permit end-to-end stackability with an adjacent header connector, the header connector also including an array of contact pins secured in the header housing between the first and second side walls for engaging the receptacle contacts of the socket connector, the contact pins including tail sections configured to be electrically coupled to the second printed circuit board, the first side wall of the header housing being formed to include a plurality of guide slots aligned with the plurality of cantilevered guide posts formed on the socket connector, the guide slots being configured to engage the guide posts as the socket connector and the header connector are mated to align the array of pin-receiving windows of the socket connector with the array of pins of the header connector prior to engagement of the array of contact pins with the plurality of receptacle contacts.

20. The connector system of claim 19, wherein the cantilevered guide posts include a body portion and a head portion having a ramp surface to facilitate insertion of the guide posts into the guide slots of the header connector.

21. The connector system of claim 20, wherein the body portion has a generally rectangular shape.

22. The connector system of claim 20, wherein the head portion includes a pair of opposed ramp surfaces to facilitate insertion of the guide posts into the guide slots of the header connector.

23. The connector system of claim 19, wherein the socket connector and header connector are configured to provide a stub length of 17.0 mm between the first and second printed circuit boards upon insertion of the header connector into the socket connector.

24. The connector system of claim 19, wherein the header connector includes a peg for engaging an alignment hole formed in the second printed circuit board to position the alignment hole of the second printed circuit board 14.0 mm away from a top surface of the first printed circuit board upon insertion of the header connector into the socket connector.

25. The connector system of claim 19, wherein a top surface of the second printed circuit board is spaced apart from a first row of the array of contact pins of the header connector by 1.5 mm.

26. An electrical connector system for coupling a first printed circuit board to a second printed circuit board, the connector system comprising:

a first connector including a first housing and a plurality of first contacts located within the first housing, the first contacts including tail sections configured to be electrically coupled to the first printed circuit board, the first housing also including a plurality of cantilevered guide posts one-piece with and extending away from a side portion of the first housing, the guide posts each having a distal end extending above the first contacts; and a second connector including a second housing and an array of second contacts secured in the second housing for engaging the first contacts of the first connector, the second contacts including tail sections configured to be electrically coupled to the second printed circuit board, the second housing being formed to include a plurality of guide slots aligned with the plurality of cantilevered guide posts formed on the first connector, the guide slots being configured to surround a distal end of the guide posts as the first connector and the second connector are mated to align the first contacts with the second contacts prior to engagement of the first contacts with the second contacts.

27. The connector system of claim 26, wherein the cantilevered guide posts include a body portion and a head portion having a ramp surface to facilitate insertion of the guide posts into the guide slots.

28. The connector system of claim 27, wherein the body portion has a generally rectangular shape.

29. The connector system of claim 27, wherein the head portion includes a pair of opposed ramp surfaces to facilitate insertion of the guide posts into the guide slots.

30. The connector system of claim 26, wherein the first connector and the second connector are configured to provide a stub length of 17.0 mm between the first and second printed circuit boards upon insertion of the second into the first connector.

31. The connector system of claim 26, wherein the header connector includes a peg for engaging an alignment hole formed in the second printed circuit board to position the alignment hole of the second printed circuit board about 14.0 mm away from a top surface of the first printed circuit board upon insertion of the header connector into the socket connector.

32. The connector system of claim 26, wherein a top surface of the second printed circuit board is spaced apart from a first row of the array of second contacts of the second connector by 1.5 mm.

* * * * *